US005739798A

United States Patent [19]

Lockmuller

[11] Patent Number: 5,739,798

[45] Date of Patent: Apr. 14, 1998

[54] ANALOGUE GREYSCALE ADDRESSING IN A FERROELECTRIC LIQUID CRYSTAL DISPLAY WITH SUB-ELECTRODE STRUCTURE

[75] Inventor: Neil Lockmuller, Middlesex, England

[73] Assignee: Central Research Laboratories Limited, Middlesex, England

[21] Appl. No.: 647,910

[22] PCT Filed: Nov. 17, 1994

[86] PCT No.: PCT/GB94/02533

§ 371 Date: May 30, 1996

§ 102(e) Date: May 30, 1996

[87] PCT Pub. No.: WO95/15548

PCT Pub. Date: Jun. 8, 1995

[30] Foreign Application Priority Data

Dec. 2, 1993 [GB] United Kingdom ..... 9324710

[51] Int. Cl.[6] ..... G09G 3/03

[52] U.S. Cl. ..... 345/67; 345/60; 345/97

[58] Field of Search ..... 345/97, 103, 147, 345/67, 60, 149

[56] References Cited

U.S. PATENT DOCUMENTS

| | | | |
|---|---|---|---|
| 3,990,068 | 11/1976 | Mayer et al. | 345/67 |
| 4,763,994 | 8/1988 | Kaneko et al. | 345/97 |
| 4,822,142 | 4/1989 | Yasui | 345/103 |
| 4,870,398 | 9/1989 | Bos | 345/97 |
| 5,075,097 | 12/1991 | Salavin et al. | 345/60 |
| 5,119,219 | 6/1992 | Terada et al. | 345/97 |
| 5,136,408 | 8/1992 | Okada et al. | 345/97 |
| 5,247,288 | 9/1993 | Warren et al. | 345/60 |
| 5,250,936 | 10/1993 | Warren et al. | 345/60 |
| 5,255,110 | 10/1993 | Mouri et al. | 345/97 |
| 5,363,225 | 11/1994 | Minamihara et al. | 345/97 |
| 5,400,046 | 3/1995 | Ilcisin et al. | 345/60 |
| 5,404,236 | 4/1995 | Hartmann et al. | 345/149 |
| 5,408,245 | 4/1995 | Kalizaki | 345/60 |
| 5,483,252 | 1/1996 | Shigeta | 345/60 |
| 5,614,924 | 3/1997 | Numao | 345/149 |

FOREIGN PATENT DOCUMENTS

| | | |
|---|---|---|
| 0224243 | 6/1987 | European Pat. Off. . |
| 0276864 | 8/1988 | European Pat. Off. . |

*Primary Examiner*—Richard Hjerpe
*Assistant Examiner*—Joseph Acosta
*Attorney, Agent, or Firm*—Evenson, McKeown, Edwards & Lenahan, PLLC

[57] ABSTRACT

A matrix of pixels of ferroelectric liquid crystal material has the pixels defined by areas of overlap between members of a first set of parallel electrodes and members of a second such set which cross the members of the first set. Each electrode of the first set includes first and second sub-electrodes connected by a resistive layer. The matrix is addressed by applying respective strobe signals simultaneously to the sub-electrodes of each electrode of the first set in turn, each time simultaneously applying data signals of variable amplitude and polarity in parallel to the electrodes of the second set. Each strobe signal includes a pre-pulse and a main pulse. The main pulses lie below and above the switching threshold of the material, respectively, and the pre-pulses are of the same polarity as, and of the opposite polarity to, the corresponding main pulse, respectively. The pre-pulses cooperate with the data signals to ensure that, when the material is operated in the inverse mode, switching is assisted where such switching is intended and is inhibited where such switching is not intended.

6 Claims, 4 Drawing Sheets

Figure 1:
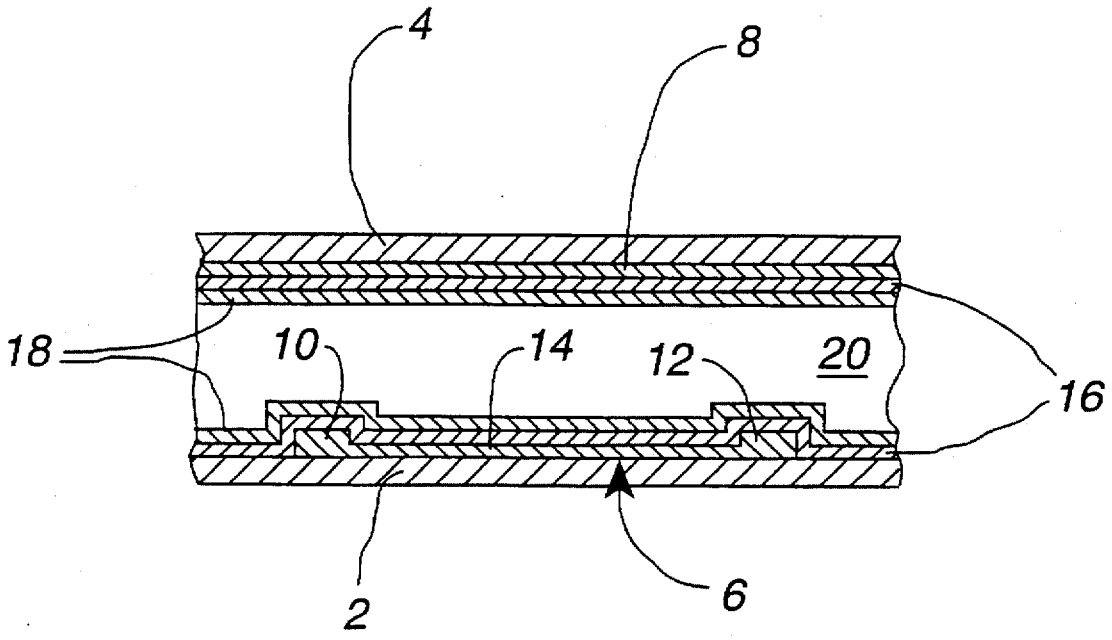

ANALOGUE GREYSCALE ADDRESSING IN A FERROELECTRIC LIQUID CRYSTAL DISPLAY WITH SUB-ELECTRODE STRUCTURE

This invention relates to a method of addressing a matrix of pixels which are defined by areas of overlap between the members of a first set of electrodes on one side of a layer of material and members of a second set of electrodes, which cross the members of the first set, on the other side of the layer of material. The material is electrically addressable to change an optical property thereof from one stable state to another stable state. Each member of the first set of electrodes comprises first and second subelectrodes which are, at opposing edges thereof, connected by a layer of resistive material at least in the pixel areas. In the method, for each electrode of the first set, a blanking pulse of a given polarity is applied to the subelectrodes thereof and thereafter a predetermined strobe signal is applied to a subelectrode thereof whilst a data signal having a chosen amplitude is applied to each electrode of the second set in parallel. The predetermined strobe signals are applied to the respective electrodes of the second set in succession.

A method of the above general kind is disclosed in EP-A-224243 and EP-A 276864. In the known method, when a strobe signal is applied to one subelectrode of an electrode of the first set the other subelectrode of that electrode is maintained at zero voltage. The result is that a voltage gradient is created between the two subelectrodes, that is, across each corresponding pixel. Thus, it can be arranged that the electric field across the layer of material of each pixel varies from one edge to the opposing edge from a level which is above the switching threshold of the material to a level which is below the threshold. The choice of data waveforms simultaneously applied to each member of the second set of electrodes determines where the switching threshold is crossed and thus how much of the corresponding pixel is switched from the blanked state. For a material such as ferroelectric liquid crystal material where the stable states are light-transmissive and non light-transmissive states for the corresponding pixel if the material is situated between crossed polarizers, the brightness level or grey level of each pixel can be controlled in this way.

A problem with such a method is that the switching threshold of the material may vary with temperature. In large matrices such as displays, for example, the temperature may vary considerably from one edge of the matrix to the center. Thus, the amount of a selected pixel which is switched by a given waveform may vary across the matrix, making control of the grey level unreliable.

It is an object of the present invention to alleviate the problems of the known prior art.

According to the present invention there is provided a method in which the predetermined strobe signals each comprise a pre-pulse and a main pulse which are of the opposite polarity to the blanking pulses. Each time a predetermined strobe signal is applied to a subelectrode, an auxiliary strobe signal is applied to the other subelectrode of the same electrode, which auxiliary strobe signal comprises a pre-pulse of the same polarity as the blanking pulses and a main pulse of the opposite polarity to the blanking pulses. Each data signal is also of chosen polarity and, when of non-zero amplitude, comprises a first pulse which coincides with the pre-pulses of the corresponding predetermined and auxiliary strobe signals and a second pulse which coincides with the main pulses of the predetermined and auxiliary strobe signals. The first and second pulses having mutually opposite polarities, in that the magnitudes of the main pulses of the predetermined and auxiliary strobe signals are, by equal amounts, respectively greater than and less than the switching threshold of the material at a predetermined working temperature. The magnitudes of the pre-pulses of the predetermined and auxiliary strobe signals are equal to the magnitude of the first pulse of a data signal which has an amplitude such that the second pulse thereof has a magnitude which is equal to the difference between the magnitudes of the main pulses and the switching threshold.

Thus, in the inverse mode of operation, where a pulse below the switching threshold causes switching whereas a pulse above the threshold does not cause switching, it can be arranged that a part of a selected pixel which is to switch experiences a pre-pulse of the same polarity which encourages switching, and a part which is not to switch experiences a pre-pulse of the opposite polarity which discourages switching.

Figure 2:
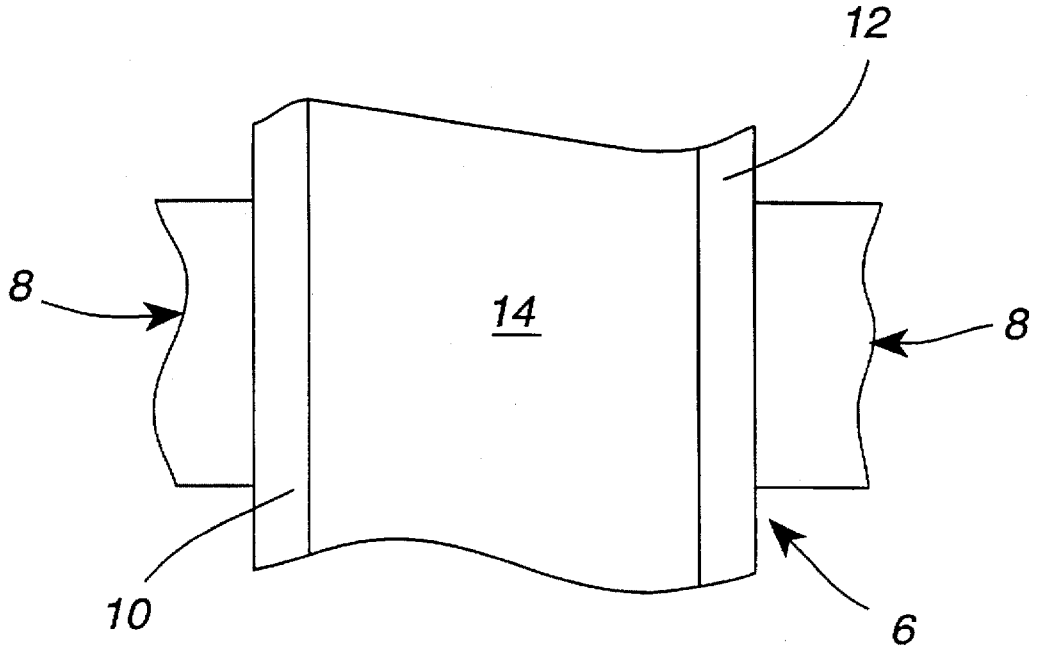
Figure 3A:
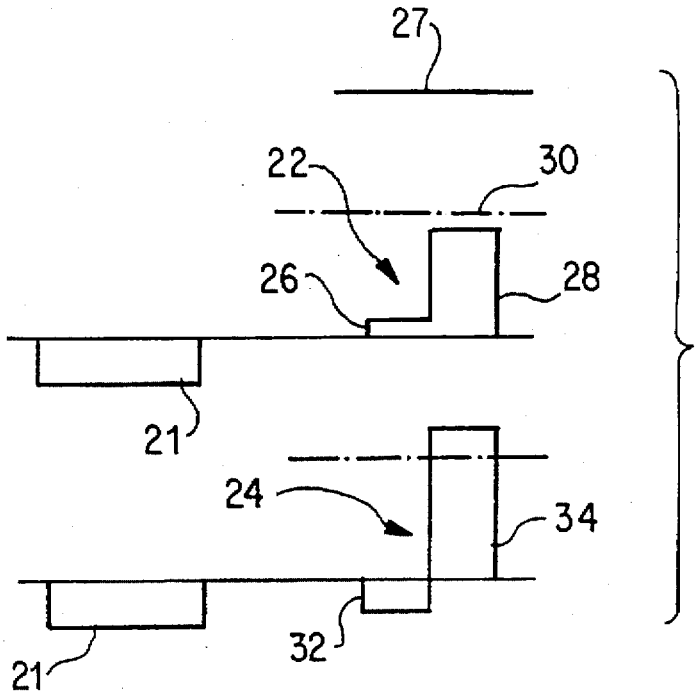
Figure 4A:
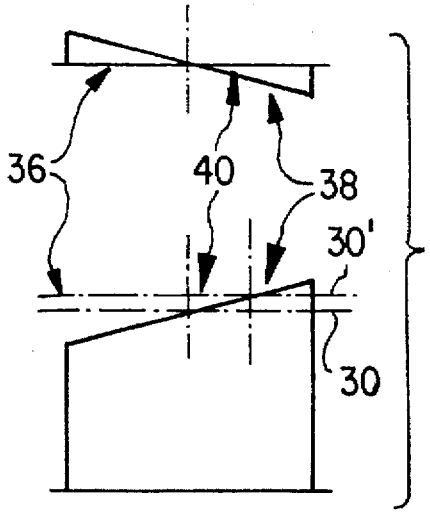

In order that the invention may be more readily understood, reference will now be made, by way of example, to the accompanying diagrammatic drawings, in which:

FIG. 1 is a cross-sectional view of a pixel in a matrix which can be addressed by a method according to the invention, FIG. 2 is a plan view of the pixel of FIG. 1;

FIGS. 3*a, b* and *c* show data and strobe waveforms together with resultant waveforms across the pixel in one embodiment of the invention; and FIGS. 4*a, b* and *c* show voltage against distance across the pixel for both the resultant pre-pulses and main pulses corresponding to FIGS. 3*a, b* and *c*.

Referring to FIGS. 1 and 2, a matrix of pixels comprises a pair of substrates 2, 4, for example of glass, carrying first and second sets of electrodes 6, 8 formed of a transparent material such as indium tin oxide (ITO). Each electrode 6 of the first set crosses all the electrodes of the second set, preferably but not necessarily at right angles, and comprises first and second sub-electrodes 10, 12 joined by a layer 14 of conductive material which has a higher resistance per square than the sub-electrodes.

Each set of electrodes is covered by a barrier layer 16 and an alignment layer 18 in a known manner. The space between them is filled with ferroelectric liquid crystal material 20, and is sealed around the edges of the substrates 2, 4.

Referring to FIGS. 3*a* to *c* and 4*a* to *c*, when the line of pixels corresponding to a member 6 of the first set of electrodes is to be addressed, first a blanking pulse (21) of a polarity, magnitude and duration such as to set all the pixels of the line to a blanked (light or dark) state is applied to both subelectrodes of the relevant electrode 6. Subsequently a predetermined strobe signal 22 and an auxiliary strobe signal 24 are applied simultaneously to respective ones of the first and second sub-electrodes 10, 12 of the relevant electrode 6. The strobe signal 22 comprises a pre-pulse 26 and a main pulse 28 of equal duration, these pulses being of the opposite polarity to the blanking pulse. The pre-pulse 26 has a voltage level Vd, and the main pulse 28 has a voltage level which is below the switching threshold 30 of the material, at a predetermined working temperature, by an amount Vd. The strobe signal 24 also comprises a pre-pulse 32 and a main pulse 34 of equal duration. The pre-pulse 32 is of the same polarity as the blanking pulse and the opposite polarity to the main pulse 34, and has a magnitude Vd. The main pulse 34 has a magnitude above the switching threshold 30 by an amount Vd. A simultaneous pair of strobe signals 22, 24 is applied to the subelectrodes 10, 12 of each electrode 6 in succession.

Each time such a simultaneous pair of strobe signals 22, 24 is applied, data signals are applied in parallel to all the electrodes 8 of the second set. Three examples of such data signals being shown in FIG. 3 at 27, 42 and 56 respectively. The polarity and amplitude of each data signal are chosen to accord with the brightness required of the pixel at the crossing point of the relevant electrode 8 with the electrode 6 to which the strobe signals are currently applied. When the amplitude of a data signal is non-zero (a zero-amplitude data signal is shown at, the data signal comprises, as will be seen from the examples at 42 and 56, first and second pulses of equal magnitude and opposite polarity, the first pulse coinciding with the prepulses 26 and 32 of the current strobe signals and the second pulse coinciding with the main pulses 28 and 34 of the current strobe signals. The maximum amplitude of each data signal corresponds to each pulse thereof having a magnitude Vd, i.e. the magnitude of the pre-pulses 26 and 32, and the amounts by which the magnitudes of the main pulses 28 and 34 are less than and greater than the threshold 30, respectively. Data signal 56 is shown as having such a maximum amplitude.

If it is required that a pixel has a brightness level of a half of the maximum level; that is, that half of the pixel is to be switched from the blanked state (e.g. the non light-transmissive state), then the data signal 27 of a zero voltage level is applied to the corresponding member 8 of the second set of electrodes. It can be seen from FIG. 4*a* that the voltage level across the pixel when the main pulses 28, 34 are applied varies from an amount Vd below the switching threshold 30 at one side to an amount Vd above the threshold at the other side. Thus, in the inverse mode of operation, half 36 of the pixel adjacent the first subelectrode 10 experiences a voltage level below the threshold 30 and switches to the other state (e.g., the light-transmissive state) while the other half 38 experiences a voltage level above the threshold, and does not switch. The half 36 which switches also experiences a positive pre-pulse which encourages switching, whilst the half 38 which does not switch experiences a negative pre-pulse, which discourages switching. Should the temperature of the material vary from the predetermined average working temperature, so that the switching threshold is for example at a higher level 30, then the main pulse tends to cause an additional part 40 of the pixel to switch. However, this part 40 still experiences a negative pre-pulse, discouraging switching and so reducing the change in brightness caused by the temperature change.

Figure 3B:
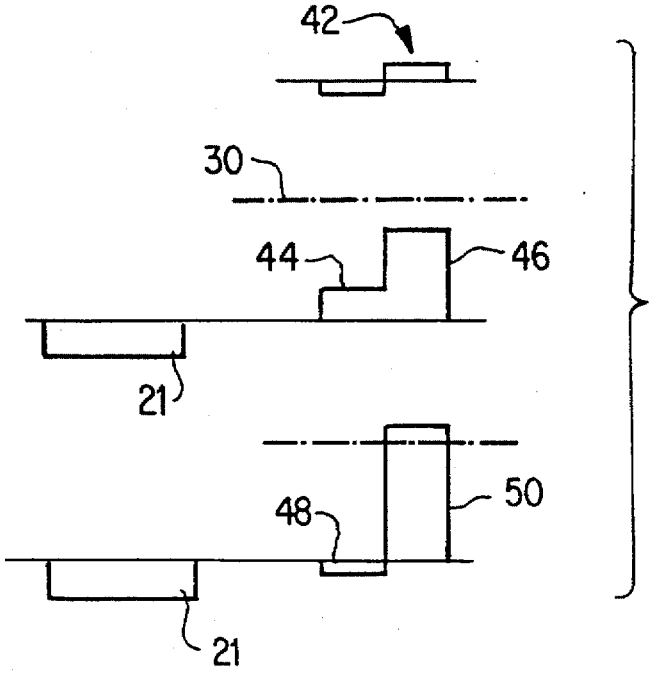
Figure 4B:
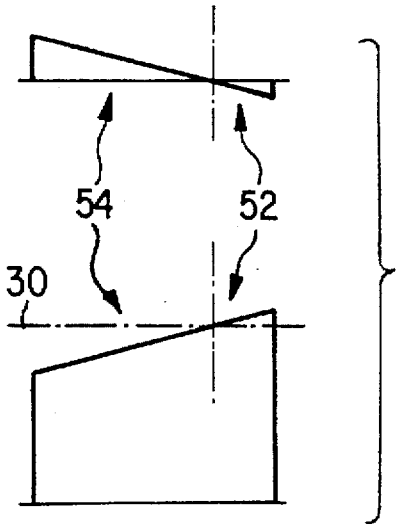

In the example shown in FIGS. 3*b* and 4*b*, it is required to switch three-quarters of the pixel. In this case, a data waveform 42 is applied which is a bi-polar charge-balanced waveform having a negative-going part of magnitude Vd/2 followed by a positive-going part of the same magnitude. The resultant waveform across the pixel at the first sub-electrode has a pre-pulse 44 of magnitude 3Vd/2, and a main pulse 46 of a magnitude which is 3Vd/2 smaller than the switching threshold 30. The resultant waveform at the second sub-electrode comprises a pre-pulse 48 of magnitude Vd/2 and a main pulse 50 which is Vd/2 above the switching threshold 30. From FIG. 4*b* it can be seen that for the duration of the main pulse one-quarter 52 of the pixel experiences a voltage level above the threshold 30 and therefore does not switch, whilst three-quarters 54 experiences a level below the threshold 30 causing switching. The pre-pulse for the one-quarter 52 of the pixel is negative and for the three-quarters 54 is positive, thus tending to reinforce the intended effect of the main pulse and stabilize the brightness level achieved at varying temperatures.

Figure 3C:
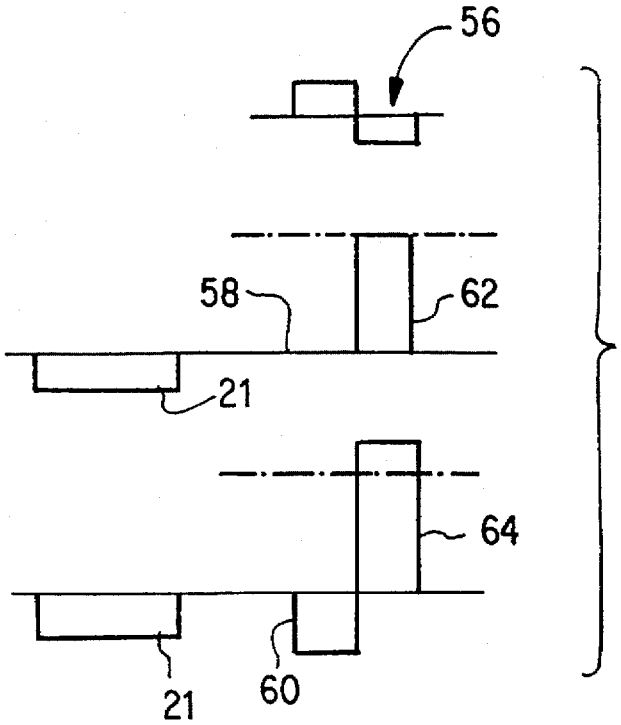
Figure 4C:
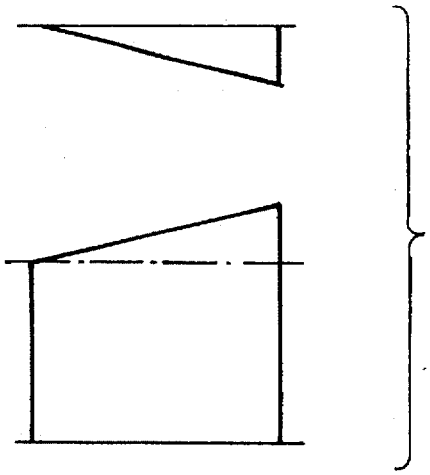

The example of FIGS. 3*c* and 4*c* shows the case where it is required that all of the pixel remains unswitched. The data waveform comprises a positive-going pulse of magnitude Vd followed by a negative-going pulse of the same magnitude. The pre-pulse 58 at the first sub-electrode is zero, and falls to a level 60 of −2Vd at the second sub-electrode. The main pulse rises from a level 62 equal to the switching threshold 30 at the first sub-electrode to a level 64 which is 2Vd above the threshold 30 at the second sub-electrode. Therefore the whole pixel tends not to switch.

Although, as described, the magnitudes of the pre-pulses 26 and 32 are equal to the difference between the threshold 30 and the heights of the main pulses 28 and 34, and each data signal, when non-zero, comprises first and second mutually opposite polarity pulses of equal magnitude, this is not essential. All that is required is that the magnitudes of the pre-pulses 26 and 32 are equal to the magnitude of the first pulse of a data signal which has such an amplitude that the second pulse has a magnitude Vd. Thus, for example, each data signal may be such that, when its amplitude is non-zero, the magnitude of its first pulse is twice the magnitude of its second pulse. In such a case the magnitudes of the pre-pulses 26 and 32 would each have to be 2Vd .

It will be appreciated that the stable states of the material referred to need be stable only for a length of time equal to the maximum period between one addressing of a pixel and the next.

I claim:

1. A method of addressing a matrix of pixels which are defined by areas of overlap between members of a first set of electrodes on one side of a layer of material and members of a second set of electrodes, which cross the members of the first set of electrodes, on the other side of the layer of material, the material being electrically addressable to change an optical property thereof from one stable state to another stable state, the material having a switching threshold at a predetermined working temperature, each member of the first set of electrodes comprising first and second sub-electrodes which are, at opposing edges thereof, connected by a layer of resistive material at least in the pixel areas, the method comprising the steps of:

applying a blanking pulse of a given polarity to the sub-electrodes of each electrode of the first set of electrodes, applying thereafter a predetermined strobe signal to one sub-electrode of an electrode from said first set of electrodes while substantially simultaneously applying an auxiliary strobe signal to the other sub-electrode of the same electrode, and applying, substantially simultaneously with application of said strobe signals, data signals having chosen amplitudes to the electrodes of the second set of electrodes, the predetermined strobe signal and auxiliary strobe signal being applied to corresponding sub-electrodes of respective electrodes of the first set of electrodes in succession, each predetermined strobe signal comprising a pre-pulse and a main pulse which are both opposite in polarity to the blanking pulse, each auxiliary strobe signal comprising a pre-pulse of the same polarity as the blanking pulse and a main pulse which is opposite in polarity to the blanking pulse, each data signal being of a chosen polarity and, when of non-zero amplitude, comprising a first data pulse which coincides with the pre-pulses of corresponding predetermined and auxiliary strobe signals and a second data pulse which coincides with main pulses of the corresponding predetermined and auxiliary strobe signals, the first and second data pulses having mutually opposite polarities, the main pulses of the predetermined and auxiliary strobe signals having magnitudes which are respectively greater than and less than the switching threshold of the layer of material, a given second data pulse and a corresponding main pulse being such that the magnitude of a voltage waveform across the layer of material of a given pixel is no less than the switching threshold for at least some of the pixels.

2. A method as claimed in claim 1 in which the magnitudes of the pre-pulses of the predetermined strobe signal and the auxiliary strobe signal are both equal to a difference between the magnitude of the switching threshold of the layer of material and the magnitude of the corresponding main pulse.

3. A method as claimed in claim 1 in which the magnitudes of the first and second pulses of each non-zero data signal are equal to each other.

4. A method as claimed in claim 2 in which the magnitudes of the first and second pulses of each non-zero data signal are equal to each other.

5. A method as claimed in claim 1 in which the areas of the first and second pulses of each non-zero data signal are equal to each other.

6. A method as claimed in claim 2 in which the areas of the first and second pulses of each non-zero data signal are equal to each other.

* * * * *